US005489123A

United States Patent [19]

Roshkoff

[11] Patent Number: 5,489,123

[45] Date of Patent: Feb. 6, 1996

[54] PACKAGING LABEL INCLUDING PRE-APPROVED INCENTIVE CARD

[75] Inventor: Kenneth S. Roshkoff, Villanova, Pa.

[73] Assignee: Attitude Measurement Corporation, South Hampton, Pa.

[21] Appl. No.: 414,843

[22] Filed: Mar. 31, 1995

[51] Int. Cl.[6] ..... B42D 15/00

[52] U.S. Cl. ..... 283/81; 283/56; 283/61; 283/101; 281/5

[58] Field of Search ..... 281/2, 5; 283/81, 283/101, 105, 56, 117; 428/40, 41, 42

[56] References Cited

U.S. PATENT DOCUMENTS

| | | | |
|---|---|---|---|
| 1,273,105 | 7/1918 | Van Dyke et al. . | |
| 2,616,612 | 11/1952 | Guttman . | |
| 4,405,157 | 9/1983 | Bennett . | |
| 4,559,727 | 12/1985 | Lewyt . | |
| 4,592,572 | 6/1986 | Instance . | |
| 4,621,837 | 11/1986 | Mack | 283/81 X |
| 4,722,554 | 2/1988 | Pettit . | |
| 5,172,936 | 12/1992 | Sullivan et al. | 283/81 |
| 5,181,744 | 1/1993 | Betheil . | |
| 5,263,743 | 11/1993 | Jones | 283/81 |
| 5,308,119 | 5/1994 | Roshkoff . | |
| 5,403,636 | 4/1995 | Crum | 283/81 X |
| 5,439,721 | 8/1995 | Pednoli et al. | 283/81 X |

*Primary Examiner*—Willmon Fridie, Jr.

*Attorney, Agent, or Firm*—Seidel Gonda Lavorgna & Monaco

[57] ABSTRACT

A label for affixing to a container and delivering a foldable document is constructed from a base layer, a strip, a pre-approved incentive card having a premium associated therewith, and a transparent outer layer. The outer layer attaches the folded strip to the base layer and encloses it between the base layer and outer layer. The outer layer is designed to be severed along at least one edge so as to allow access to the strip and the pre-approved incentive card. The pre-approved incentive card must be activated before a purchaser may redeem the premium.

17 Claims, 2 Drawing Sheets

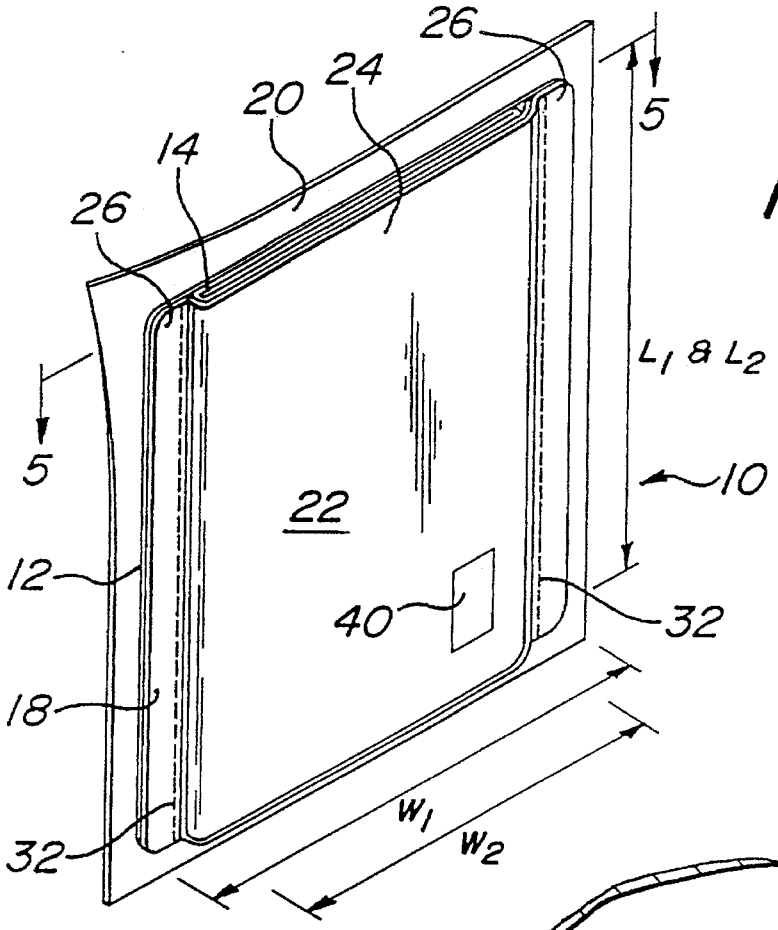
FIG. 1
FIG. 2
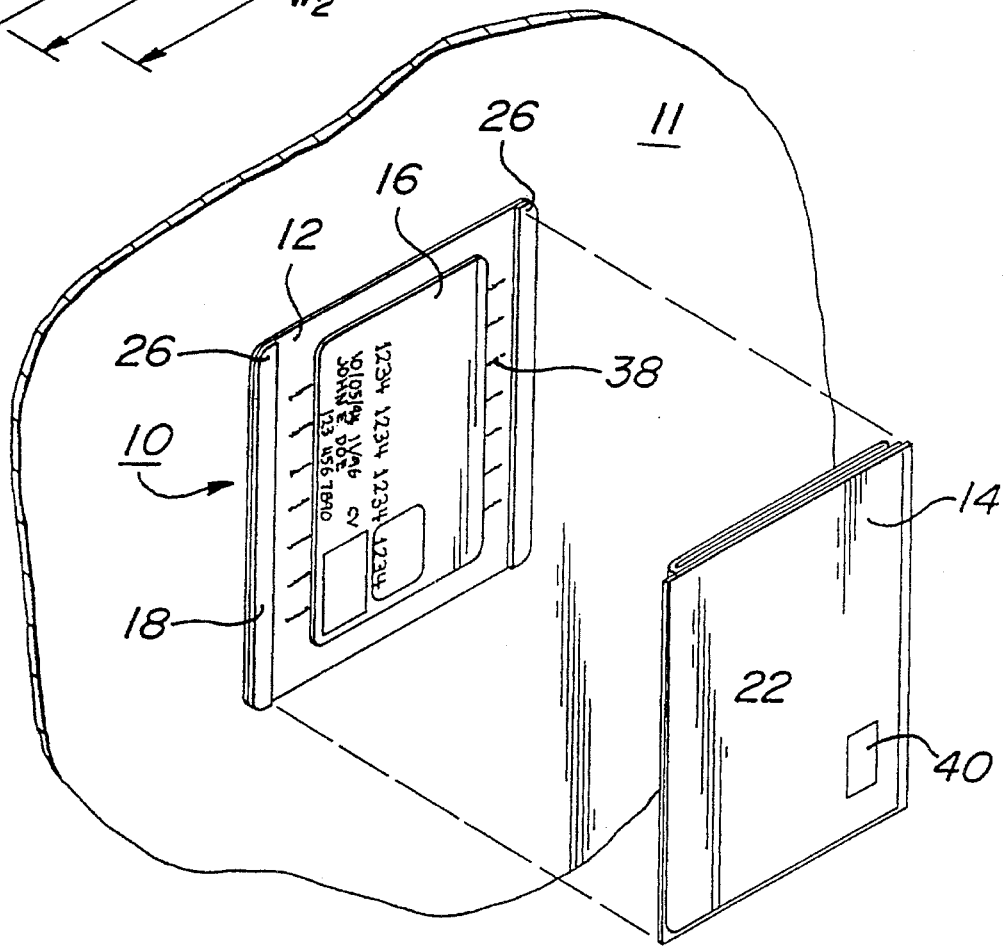

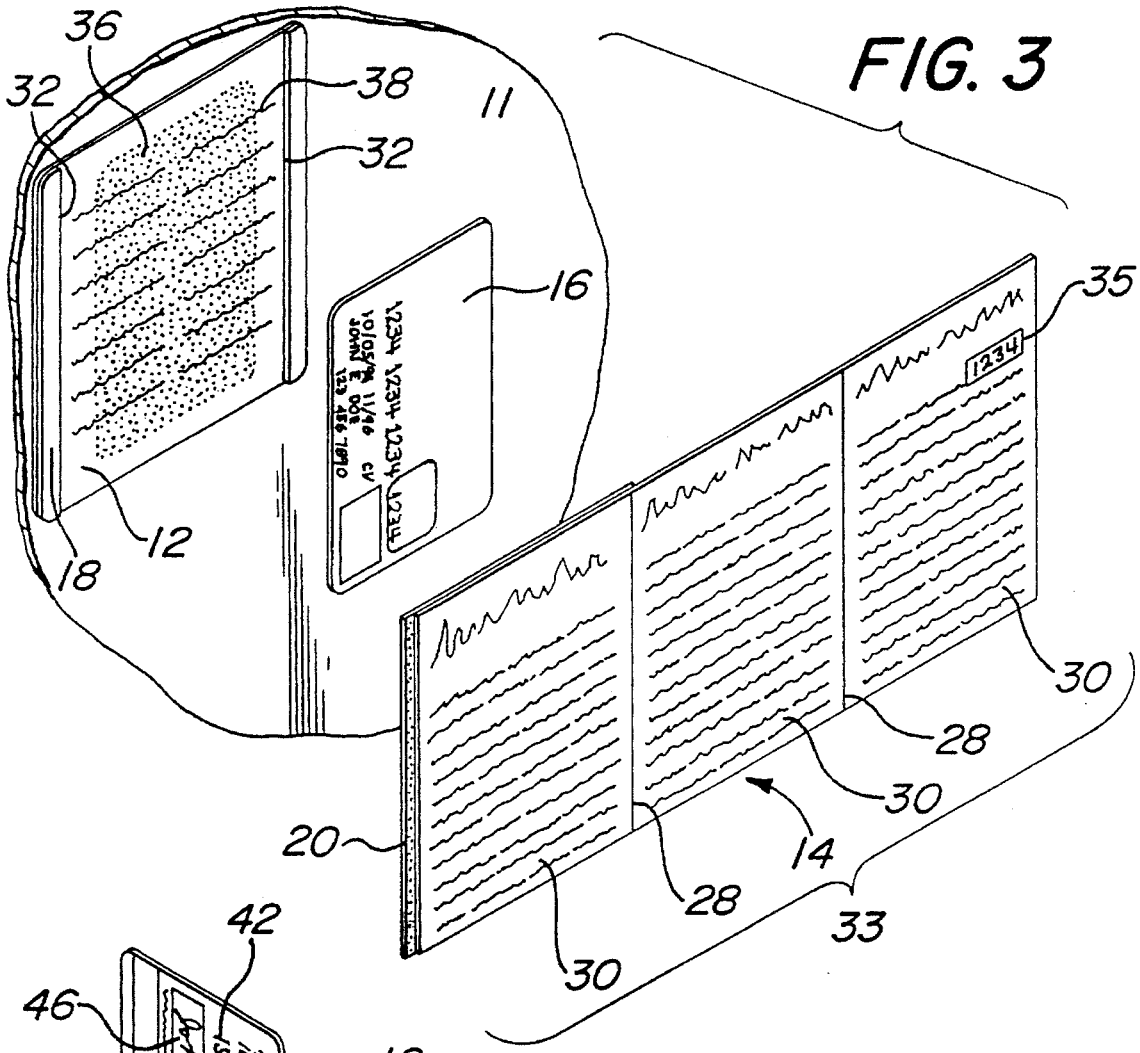
FIG. 3
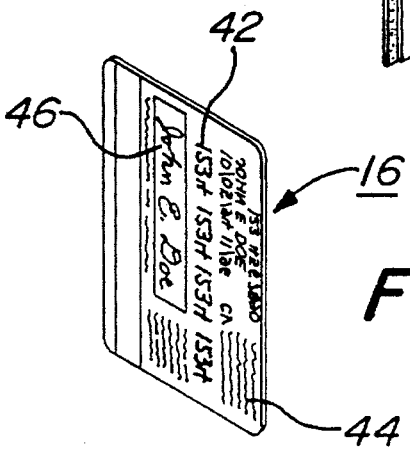
FIG. 4
FIG. 5
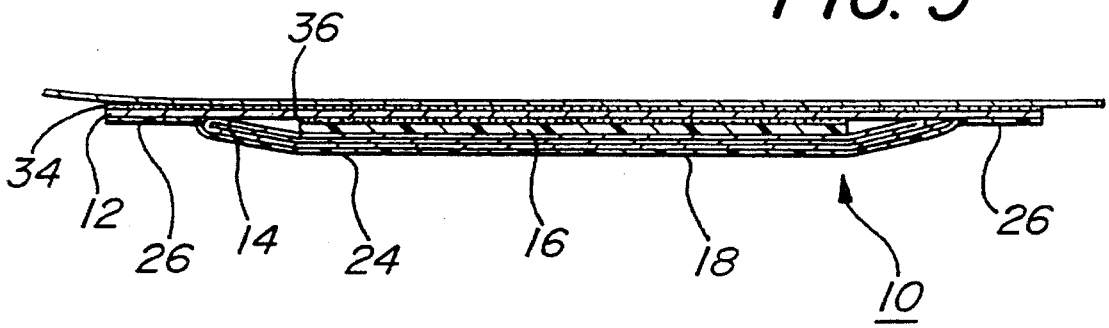

PACKAGING LABEL INCLUDING PRE-APPROVED INCENTIVE CARD

FIELD OF THE INVENTION

This invention relates to a packaging label designed to be placed on a container at its point of purchase which contains a pre-approved incentive card therein, which entities the bearer to receive a premium or fixed amount of goods or services. The pre-approved incentive card must be activated before the purchaser can receive the value of the premium. The card may be activated by participating in a survey and thereby receiving an access code for redeeming the premium. For illustrative purposes only, the invention is described in the context of a telephone calling card being the pre-approved incentive card, but the invention is not so limited.

BACKGROUND OF THE INVENTION

Premiums to entice a consumer to purchase a product have been used for many years. Inexpensive toys of one form or another have been put in cereal boxes and boxes of caramel corn to encourage young children, or parents of young children, to purchase a particular brand of cereal or snack.

Packaging labels which include materials of value of interest to more mature consumers are also known in the art. Typically, such materials include coupons, mail-in rebates, sweepstakes entry forms, product literature or related product information. Such materials are typically delivered by multi-panel labels, expanded content labels or expanded content labels affixed to a product package.

There is more to marketing, however, than simply enticing a purchaser by offering free premiums. Retailers and manufacturers increasingly seek information from consumers about the products consumers buy, and the reasons consumers like or dislike certain products, as a way of improving a product or its marketing methods. Such information is typically obtained through surveys. In some cases, a survey is done by personally interviewing consumers about their purchases and preferences. This type of survey is usually done right at a retail outlet. To be effective, the interviews must be done by experienced survey takers. This type of survey is clearly very expensive to conduct.

To cut costs, manufacturers and retailers have resorted to the use of sweepstakes entry forms or rebate coupons to elicit survey data from consumers once a purchase is made. This type of survey is less expensive than one which requires personal interviews, but nonetheless has drawbacks of its own. This type of survey is inefficient due to the historically low redemption rate, typically less than 10 percent, of such forms or coupons.

Moreover, for surveys of this type to be meaningful, the survey itself should not distort the responses. Deliberate purchasing enticements skew the survey data results. A company that wishes to understand the profile of its customers prefers to discover who is purchasing its products, absent any deliberate enticement to do so. Therefore, it is usually desirable when attempting to collect survey results via product purchasing to obscure the fact that a valuable premium is attached to the product until after the customer has made the purchase.

The ability to obtain questionnaire data from customers in a manner that both elicits a response without necessarily enticing a purchase and is also adaptable to the myriad types of container and products available in retail stores remains a challenge in the art.

Accordingly, there is a need for a pre-approved incentive card delivery system that is adaptable to the myriad types of containers and products available in retail stores and that allows delivery of a pre-approved incentive card that requires a recipient to participate in a survey to redeem the premium via a stick-on label in such a manner that both draws customer attention to the presence of the card within the label while not explicitly revealing its presence in a retail store. Furthermore, there is a need for a label which can provide an incentive card in combination with necessary product labeling information even if the stick-on label covers up all or part of the product container's label. The present invention fills those needs.

SUMMARY OF THE INVENTION

The present invention comprises a label for affixing to a container, having a base layer, a strip, a pre-approved incentive card, and a transparent outer layer. The base layer has an adhesive side for affixing it to the container and an imprinting side for printing indicia thereon. The imprinting side has oppositely disposed edges flanking a product information portion. The product information portion at least partially underlies an adhesive layer to which the pre-approved incentive card is releasably attached. The strip overlies the product information portion. The strip may be folded into a plurality of overlying panels by fold lines with at least a portion of an outer panel forming a product information label. The transparent top layer is permanently attached to at least a part of the outer panel and both oppositely disposed edges of the base layer, thereby attaching the strip to the base layer and enclosing the strip between the top layer and the base layer. The transparent outer layer has at least one perforation running along one edge. The transparent top layer is severable along at least said one edge so as to allow access to the pre-approved incentive card.

In one embodiment, the pre-approved incentive card must be activated before the purchaser can redeem the premium of the pre-approved incentive card. The pre-approved incentive card, such as a telephone calling card, is activated by participating in a survey, preferably a telephone survey. Such a pre-approved incentive card may be activated at the conclusion of the survey by providing an access code that allows the purchaser to enjoy a fixed amount of free long distance calling service.

In another embodiment, the product information portion and the product information label contain substantially similar information, except that the product information label includes a product identifying bar code which is absent from the product information portion.

In yet another embodiment, the present invention defines a pre-approved incentive card delivery system and label having a base layer, a document, a pre-approved incentive card, and a transparent upper layer. The base layer has an adhesive side for affixing it to a container and an imprinting side for printing indicia thereon. The imprinting side has oppositely disposed edges flanking a product information portion. The document overlies the product information portion and pre-approved incentive card. The document may be folded into a plurality of overlying panels by fold lines with a least a portion of an outer panel forming a product information label. The transparent upper layer is attached to at least a part of the outer panel and both oppositely disposed edges of the base layer, thereby attaching the document to the base layer and enclosing the document between the upper layer and the base layer.

BRIEF DESCRIPTION OF THE DRAWINGS

For the purpose of illustrating the invention, there is shown in the drawings a form which is presently preferred; it being understood, however, that this invention is not limited to the precise arrangements and instrumentalities shown.

FIG. 1 illustrates a perspective view of a preferred form of a label in accordance with the invention before being opened.

FIG. 2 shows a perspective view of the label after it is opened, but before a pre-approved incentive card disposed therein has been removed.

FIG. 3 shows a perspective view of the opened label after the pre-approved incentive card disposed therein has been removed.

FIG. 4 shows a perspective view of the rear of the pre-approved incentive card after it has been removed from the label.

FIG. 5 shows a side view of the unopened label taken along axis line 5—5 of FIG. 1.

DESCRIPTION OF THE PREFERRED EMBODIMENT

While the invention is described herein in connection with a preferred embodiment, it is understood that it is not intended to limit the invention to that embodiment. On the contrary, it is intended to cover all alternatives, modifications and equivalents as may be included within the spirit and scope of the invention as defined by the appended claims.

The term "pre-approved incentive card" in this invention is meant to include an article entitling the bearer to receive a premium of a fixed amount of goods or services, wherein the article must be activated before the bearer may redeem the value of the premium. The article may be activated by participating in an interview or survey. An example of a pre-approved incentive card is a prepaid telephone calling card which entitles the bearer to free long distance telephone service for a period of time. Additional examples are debit cards that entitle the bearer to purchase food, gasoline, etc upon the completion of a survey. Preferably, the survey is conducted telephonically. A pre-approved incentive card is clearly distinguished from other forms of enticement material such as coupons (both rebate and cents-off) and other "mail-in" type offers. These other forms of promotional material do not in all cases place in the customer's hands a valuable instrument that can be redeemed at little inconvenience to the customer.

FIG. 1 shows a perspective view of an exemplary label which incorporates therein the novel features. Label 10 comprises four discrete parts, a base layer 12, a strip 14, a pre-approved incentive card 16, and a top layer 18. Strip 14 is typically, but not necessarily, made of paper. When joined together as described, the four discrete parts form a single, unitary structure which is affixed to a container.

Base layer 12 has length $L_1$ and width $W_1$. Adhesion to the container is obtained by a suitable adhesive on the back of the base layer 12, such as a pressure sensitive adhesive 34 (see FIG. 5), as is well-known in the art. Before application of the label 10 to a container, the label 10 in its FIG. 1 form may be stored on wax-coated or plastic-coated release paper 20. The label 10 can then be easily peeled off the release paper 20, exposing the pressure sensitive adhesive 34. Since the adhesive 34 of the base layer 12 does not form any part of the invention and is well-known in the label-affixing art, no further description has been provided. Base layer 12 is clear or opaque so as to allow for printing of product information thereon, as described below.

FIG. 1 also shows strip 14 after it has been folded up to form panels (to be further described below) and placed on top of base layer 12. The width, $W_2$, of the folded strip 14 is slightly less than the width, $W_1$, of the base layer 12. The folded strip 14 is centered widthwise with respect to the base layer 12. Although the length, $L_2$, of the strip 14 is depicted as being identical to the length, $L_1$, of the base layer 12, it should be recognized that the length dimensions are not critical. $L_1$ could be greater than $L_2$, thereby exposing a portion of the base layer 12. The outwardly facing panel 22 of strip 14 comprises a product information label. The inwardly facing panels of strip 14 may contain written material and may form an instruction booklet or sheet explaining how to participate in a marketing survey and/or provide advertising for the product as described below. In the preferred embodiment, a bar code label 40 is preferably disposed on the panel 22. Thus, the product information label on panel 22 can contain all pertinent information relating to the container on which it is affixed.

As shown in FIG. 1, top layer 18 has a main portion 24 which overlies panel 22, and oppositely disposed edge portions 26 which overlie the base layer 12. Main portion 24 and edge portions 26 are partially delineated by perforations 32. Top layer 18 has substantially the same width as the base layer 12 (discounting the slightly increased width necessary to accommodate the thickness of the folded strip 14). The length of the top layer 18 is preferably similar to the length, $L_2$, of the strip 14 so as to ensure that the entire length of the panel 22 is adhered to the top layer 18 and to create a smooth and flush outer surface. In the preferred embodiment, top layer 18 is a transparent adhesive material, such as transparent tape. Thus, the top layer 18 provides a lamination-type protection for panel 22, while simultaneously attaching the folded strip 14 to base layer 12.

FIG. 2 depicts the label 10 after it has been opened, but before pre-approved incentive card 16 disposed therein has been removed. A purchaser of a container 11 including label 10 is instructed (by appropriate directions preprinted on panel 22, for example) to sever the top layer 18 along at least one edge which seals the edge of the strip 14 to base layer 12. In the exemplary embodiment, the right and left edges are severed. However, it is not necessary to sever the both edges in order to gain access to the pre-approved incentive card 16. It is evident that if the left edge were severed and the right edge were left intact, or conversely, the pre-approved incentive card 16 could still be reached.

FIG. 3 depicts the opened label 10 after the pre-approved incentive card 16 disposed therein has been removed. This view reveals strip 14 as having a series of fold lines 28 which define a plurality of panels 30. The sum of the individual panels 30 comprise a booklet 33. As the customer unfolds the booklet 33, inwardly facing panels 30 are visible and can be used to provide additional indicia. For example, the indicia may thank a customer for purchasing the container 11 and may provide instructions for completing a survey and activating the enclosed pre-approved incentive card 16. In the alternative, one of the individual panels 30 of booklet 33 may be a simulated card having an identification number 35. The bearer of the identification number 35, in combination with an access code given at the conclusion of a survey, would be entitled to redeem the premium associated with the identification number 35.

A product information portion 38 may also be provided on the region of the base layer 12 bounded by the edge portions 26 of the top layer 18. The product information portion 38 may contain information similar to the product information label on panel 22 or additional information. Thus, when the customer after purchase removes top layer 18 and pre-approved incentive card 16, the container 11 still has affixed the necessary product information. This is important when label 10 partially or completely obscures the original labeling when label 10 is affixed to the container 11. In the depicted embodiment, bar code 40 is not printed on product information portion 38. The absence of the bar code 40 from the container 11 alerts a cashier or store personnel that label 10 has been tampered with, thereby serving as a built-in tamper evident feature.

This view also reveals the area over which a releasable adhesive 36 may be applied in order to releasably secure pre-approved incentive card 16 thereto. The pre-approved incentive card 16 thus may easily be peeled away from base layer 12. Releasable adhesive 36 may be applied to base layer 12 over substantially the entire area to be occupied by pre-approved incentive card 16 or may be applied in strips or other configurations. Adhesive 36 should not obscure the view of product information portion 38. A releasing agent (not shown) may also be applied directly onto pre-approved incentive card 16. The method of applying adhesive 36 is well known in the label-affixing art and does not form a part of the present invention. Accordingly, no further discussion of the means for applying adhesive 36 is provided.

FIG. 4 depicts pre-approved incentive card 16 after it has been separated from the base layer 12. Although pre-approved incentive card 16 has been illustrated as having a generally rectangular configuration, the shape is not important. This view also reveals that pre-approved incentive card 16 may further include alphanumeric indicia identifying a source, organization, or identification number. The identification number may be used, when activated, to receive a premium associated with the identification number. The indicia may be embossed lettering 42 or printed material 44, or both. A signature strip 46 may also be provided on the pre-approved incentive card 16.

FIG. 5 depicts a side view of the unopened label 10 taken along axis line 5—5 of FIG. 1. This view shows the four parts: base layer 12 with adhesive 34, strip 14, pre-approved incentive card 16 with adhesive 36, and top layer 18 with main portion 24 and oppositely disposed edge portions 26.

In the depicted embodiment, the pre-approved incentive card 16 is a prepaid telephone calling card that must be activated in order to redeem the premium. The pre-approved incentive card 16 may optionally be any form of a debit card having a premium associated therewith, wherein the premium may not be redeemed until activated at the conclusion of a survey.

In accordance with one method of using the present invention, label 10 is provided on a randomly selected number of products, in which pre-approved incentive card 16 is a prepaid telephone card. Instructions am provided on panel 30 directing the recipient of the pre-approved incentive card 16 to dial a telephone number which places the recipient in contact with either a live operator or an interactive voice response system. At that time, the recipient participates in an interview or survey. At the end of the survey, the pre-approved incentive card 16 is activated, such as by giving the recipient an access code which enables the recipient to enjoy a fixed number of minutes of free long distance calling services. When the calling time is expended, the recipient has the option of either disposing of the pre-approved incentive card 16 or refreshing the pre-approved incentive card 16, either by making a monetary payment or by participating in further marketing research.

It should be noted that the strip 14 could be any form of a foldable document. It could even fold out in more than one direction. It is only required that, once folded, it fit between base layer 12 and top layer 18. It is also contemplated that one edge of the top layer 18 could be of a peel-and-stick type adhesive so that this edge could be repeatedly attached and detached without destroying the integrity of the label 10. In this alternative construction, access to the foldable document requires only detaching the peel-and-stick edge.

Also, as noted above, additional printed indicia such as coupons or other customer enticements could be included in the strip 14. Additional perforation lines could alternatively be made in order to allow for easy removal of such enticements.

The novel label has other possible uses. The label could serve as a purchase enticement vehicle. The three-dimensional nature of the multi-layer label provides a visible, physical indication to the customer that the purchase of a particular product includes some form of a bonus. Alternatively, enticement indicia on the outer panel 22 or visible edges of the base layer 12 (e.g., "Pre-approved Incentive Card Enclosed Inside") could explicitly communicate that the purchase comes with a valuable pre-approved incentive card 16. Furthermore, the label 10 could be used as a sole packaging label, thereby minimizing product container preparation costs. In this manner, the label 10 serves the dual purpose of identifying products, providing a pre-approved incentive card 16 therein, informing the purchaser that the pre-approved incentive card 16 can be activated upon the completion of a survey, and still provide product identification information if a portion of the label (e.g., strip 14) is removed.

The novel packaging label 10 described above provides significant advantages not contemplated by prior art packaging labels. Virtually any product container can now be used as a delivery system without concern for any unintentional obscuring of the container's original label. Furthermore, the label is designed to alert the customer or store personnel that label tampering has occurred.

The present invention may be embodied in other specific forms without departing from the spirit or essential attributes thereof and, accordingly, reference should be made to the appended claims, rather than to the foregoing specification, as indicating the scope of the invention.

I claim:

1. A label for affixing to a container comprising:

(a) a base layer having an adhesive side for affixing to the container and an imprinting side for printing indicia thereon forming a product information portion, the imprinting side having oppositely disposed edges;

(b) a strip overlying at least a part of the product information portion;

(c) a removable pre-approved incentive card having a premium associated therewith, wherein the incentive card must be activated before the premium may be redeemed, between the base layer and strip; and (d) a transparent top layer permanently attached to at least a part of (i) the strip; and (ii) both oppositely disposed edges of the base layer, thereby attaching the strip to the base layer and enclosing the strip between the top layer and the base layer, the transparent top layer being severable along at least one edge so as to allow access to the pre-approved incentive card.

2. The label of claim 1 wherein the pre-approved incentive card is a prepaid telephone calling card.

3. The label of claim 1 wherein the pre-approved incentive card is a debit card.

4. The label of claim 2 wherein the pre-approved incentive card is activated at the end of a survey by providing the bearer with an access code.

5. A pre-approved incentive card delivery system and label comprising:

(a) a base layer having an adhesive side for affixing to a container and an imprinting side for printing indicia thereon forming a product information portion, the imprinting side having oppositely disposed edges;

(b) a document overlying at least a part of the product information portion, wherein the document includes an outer panel forming a product information label;

(c) a removable pre-approved incentive card having a premium associated therewith, wherein the card must be activated before the premium may be redeemed, provided between the base layer and strip; and (d) a clear upper layer attached to at least a part of (i) the outer panel; and (ii) both oppositely disposed edges of the base layer, thereby attaching the document to the base layer and enclosing the document between the upper layer and the base layer.

6. The pre-approved incentive card delivery system and label of claim 5 wherein the document is folded so as to allow access to the pre-approved incentive card by detaching only one edge of the upper layer from an edge of the base layer.

7. The pre-approved incentive card delivery system and label of claim 5 wherein the pre-approved incentive card is activated by participating in a survey.

8. The pre-approved incentive card delivery system and label of claim 5 wherein the clear upper layer is severable along at least one edge so as to allow access to the pre-approved incentive card.

9. A label for affixing to a container comprising:

(a) a base layer having an adhesive side for affixing to the container and an imprinting side for printing indicia thereon forming a product information portion, the imprinting side having oppositely disposed edges;

(b) a strip overlying at least a part of the product information portion, wherein at least a portion is a pre-approved incentive card having a premium associated therewith and the incentive card must be activated before the premium may be redeemed; and (c) a transparent top layer permanently attached to at least a part of (i) the strip; and (ii) both oppositely disposed edges of the base layer, thereby attaching the strip to the base layer and enclosing the strip between the top layer and the base layer, the transparent top layer being severable along at least one edge so as to allow access to the pre-approved incentive card.

10. A method for inducing an individual to participate in a survey comprising:

a) affixing to a container, a label having a top layer, a base layer, a strip underlying the top layer, and a pre-approved incentive card;

b) providing instructions for at least partially separating the top layer and strip from the base layer, thereby exposing the pre-approved incentive card;

c) providing instructions for activating the pre-approved incentive card in order to redeem the premium; and d) activating the pre-approved incentive card at the conclusion of the survey.

11. The method as defined in claim 10 wherein the top layer is severable along at least one edge so as to allow access to the pre-approved incentive card.

12. The method as defined in claim 10 wherein the pre-approved incentive card is releasably secured to the base layer.

13. The method as defined in claim 10 wherein the container on which the label is provided is randomly selected.

14. The method as defined in claim 10 wherein the pre-approved incentive card is activated by participating in a survey.

15. The method as defined in claim 14 wherein the pre-approved incentive card is a prepaid telephone calling card.

16. The method as defined in claim 15 wherein the prepaid telephone calling card is activated by providing the bearer with an access code.

17. The method as defined in claim 10 wherein the pre-approved incentive card is a debit card.

* * * * *